United States Patent [19]

Pfrommer

[11] 4,434,627

[45] Mar. 6, 1984

[54] STITCH FORMING DEVICE FOR KNITTING MACHINES

[75] Inventor: Bruno Pfrommer, Emmetten, Switzerland

[73] Assignee: Textilma AG, Hergiswil, Switzerland

[21] Appl. No.: 369,645

[22] Filed: Apr. 19, 1982

[30] Foreign Application Priority Data

May 14, 1981 [CH] Switzerland ..... 3135/81

[51] Int. Cl.[3] ..... D04B 35/04

[52] U.S. Cl. ..... 66/120

[58] Field of Search ..... 66/120

[56] References Cited

U.S. PATENT DOCUMENTS

| | | | |
|---|---|---|---|
| 1,364,088 | 1/1921 | Fenn | 66/120 |
| 1,391,033 | 9/1921 | Wilcomb | 66/120 |
| 1,461,007 | 7/1923 | Taft | 66/120 |
| 3,386,269 | 6/1968 | Pynegar et al. | 66/120 |
| 4,210,003 | 7/1980 | Sqrillo et al. | 66/120 |

FOREIGN PATENT DOCUMENTS

| | | | |
|---|---|---|---|
| 1024634 | 3/1966 | United Kingdom | 66/120 |

*Primary Examiner*—Ronald Feldbaum
*Attorney, Agent, or Firm*—Werner W. Kleeman

[57] ABSTRACT

A stitch forming device comprises a hook element and a closure element. The hook element is fabricated from an unweakened, solid or strong body member and enables constructing the hook so that it also is extremely robust. The hook element is slidingly supported by the closure element which is fabricated from a simple profile member. By virtue of the configuration which is imparted to the stitch forming device there is possible, on the one hand, a simple and economical production and, on the other hand, because of the robustness and the relatively short displacement movement needed for knocking-off the stitches there can be utilized increased working speeds and there is obtained a longer service life or longevity. By means of rotational movements, which both elements can accomplish relative to one another, it is possible to obtain novel knitted goods possessing twist effects.

13 Claims, 9 Drawing Figures

STITCH FORMING DEVICE FOR KNITTING MACHINES

BACKGROUND OF THE INVENTION

The present invention relates to a new and improved construction of stitch forming device or unit, also referred to as a stitch former, for knitting machines or the like.

Generally speaking, the stitch forming device or unit of the present development is of the type containing a hook element and a closure element by means of which there can be closed the hook of the hook element, in order to knock-off or slough knitted stitches or float stitches by carrying out a relative displacement or sliding movement between the hook element and the closure element.

The use of such known stitch forming devices, for instance as knitting needles in the knitting art, as well as for the fabrication of knitting goods and also for the fabrication of hosiery goods, enables avoiding the drawbacks associated with conventional latch needles. Equally, it is possible to attain the required still greater working speeds. In particular, this is so because the necessary sliding movement for the hook element and the closure element is relatively short.

Stitch forming devices or units of such type, also designated as "compound needles", are continuously employed in warp knitting machines, for instance in Raschel knitting machines. They are constructed as latchless or tongueless hook or bearded needles and at the region of the hook, within the needle body, possess a displaceably or slidably mounted hook closure element.

With certain of such known needles at least the hook of the needle is formed from a tubular member. During the closing operation the slide element is introduced into the hollow space of the hook.

Although these so-called compound needles enable working with greater operating speeds than with the conventional latch needles, there is still present the complicated fabrication procedures associated with such needles and, thus, the relatively high production costs.

Apart from the already mentioned difficulties which arise during forming the hook from the needle body, there is present a further difficulty because there must be additionally provided in the needle body a hollow space for the mounting of the slide or displacement element. The end of the needle body, also the hook itself and the end of the closure element are relatively weak, tend to wear rapidly and, thus, have a short service life or longevity. Additionally, these known stitch forming devices or units possess a better functional reliability if they are supported by common bars and/or controlled, than if they are separately guided and controlled.

SUMMARY OF THE INVENTION

Therefore, with the foregoing in mind it is a primary object of the present invention to provide a new and improved construction of a stitch forming device for knitting machines which is not afflicted with the aforementioned drawbacks and limitations of the prior art proposals.

Another and more specific object of the present invention aims at providing a new and improved construction of stitch forming unit or device of the previously mentioned type which, in comparison to the known stitch forming units, allows for a simpler and more economical fabrication thereof as well as designing the hook element and the closure element to be more robust and resistant, so that there can be obtained still greater operating or working speeds.

Still a further significant object of the present invention aims at providing a new and improved construction of a stitch forming device or unit possessing increased service life and suitable for the common collective control of a number of stitch forming devices as well as also for the separate control of each individual stitch forming device or unit.

Now in order to implement these and still further objects of the invention, which will become more readily apparent as the description proceeds, the stitch forming device for knitting machines or the like is manifested by the features that the hook element is slidingly supported by the closure element.

An important advantage of the invention in contrast to the heretofore known stitch forming devices, wherein one is concerned with the previously discussed compound needles or the usual latch needles, is predicated upon the fact that the hook element is formed from a solid body member. Consequently, particularly at the region of the hook, it can be designed to be much stronger. In comparable fashion the closure element, just as the hook element, can be constructed from simpler profile body members or sectional shapes, for instance a U-shaped profile member or a hollow body member for the closure element, and a simple rod having a circular or round cross-sectional area for the hook element. Another important advantage resides in the fact that, the hook element can perform relative rotational movements with respect to the closure element, and thus, due to the rotation of the knitted stiches or float stitches there can be obtained novel knitted goods having twist effects.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
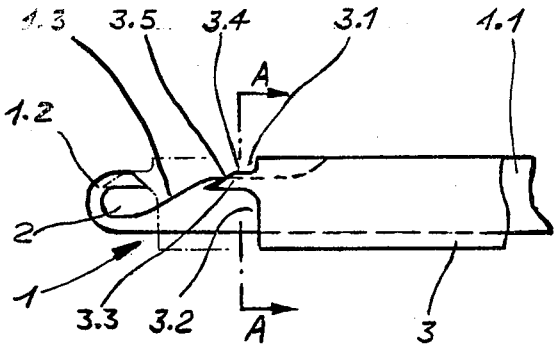
FIG. 1 is a fragmentary view of a stitch forming device or unit according to a first exemplary embodiment of the invention.

In the drawings of FIGS. 1, 3, 5, 7 and 10, various embodiments of the stitch forming device or unit—sometimes referred to simply as a stitch former—have been shown which generally comprise a hook element and a closure element which are movable relative to each other by conventional means which are, therefore, not particularly illustrated. The two element are shown in one of their relative positions by continuous or solid lines, while another relative position of these two elements is indicated by dash-dotted lines.

Figure 2:
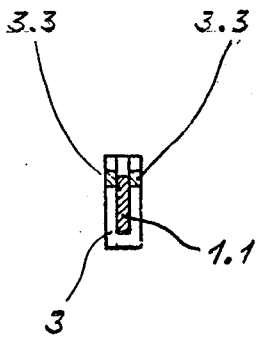
FIG. 2 is a sectional view of the stitch forming device or stitch former shown in FIG. 1, taken substantially along the line A—A.

Describing now the drawings, the stitch forming device or unit—shown by way of example and not limitation in FIGS. 1 and 2 and constituting a first exemplary embodiment of the invention, comprises a hook element 1 composed of a body member 1.1 and a hook 1.2 arranged at one end of the body member 1.1. At a bevelled or inclined portion 1.3 of the body member 1.1 there merges a hollow throat or groove 2 for the reception of a thread or yarn or the like. The body member 1.1 of the hook element 1 possesses a substantially rectangular cross-sectional configuration, as best seen by referring to FIG. 2, and is supported by a substantially U-shaped profile member 3 which is constructed as a closure element 3 for the hook 1.2. Between both of the not particularly referenced side flanges of the U-shaped profile member 3 there is guided the hook element 1. The closure element 3 possesses at the end confronting the hook opening or groove 2 of the hook element 1 an upper notched or stepped portion 3.1 and a lower notched or stepped portion 3.2 and therebetween, at each flaange side of the support body of the closure element 3, a narrow nose or nose member 3.3, the outer surface 3.4 of which is arranged higher than the apex of the bevelled or inclined portion 1.3 of the body member 1.1 of the hook element 1. The end surface of the nose member 3.3 possesses a bevelled or inclined portion 3.5 which is inclined in the same direction as the direction of inclination of the bevelled portion 1.3 of the body member 1.1 of the hook element 1. In the open hook position of the stitch forming device as shown in FIG. 1, the bevelled portions 3.5 of both nose members 3.3 are in coincidence with the bevelled portion 1.3 of the body member 1.1 of the hook element 1.

In order to form a stitch there is accomplished a movement towards the front portion of the hook element 1 and/or a common movement of the hook element 1 and the closure element 3. The knitted stitch or float stitch which was last located in the hollow throat or groove 2 is already raised by the bevelled portion 1.3 and placed by the bevelled portion 3.5 of the end surface of the nose member 3.3 upon the outer surface 3.4 of the nose member 3.3 and into the upper notched or stepped portion 3.1. By carrying out a relative displacement or sliding movement between the closure element 3 and the hook element 1 there is sloughed or knocked-off the knitted stitch or float stitch placed upon the notched portion 3.1 over the hook 1.2, and at the same time there is formed a new stitch, in conventional fashion, with the new thread or yarn which has been inserted into the hollow throat 2.

Figure 3:
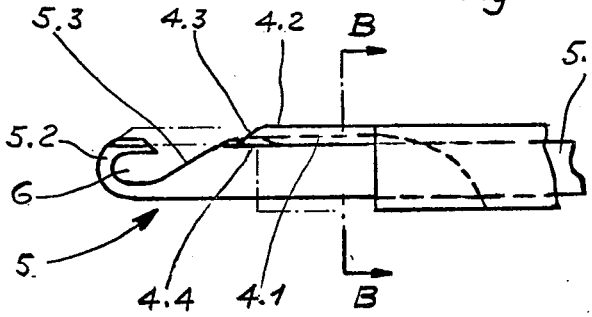
FIG. 3 is a fragmentary view of a second embodiment of stitch forming device according to the invention.
Figure 4:
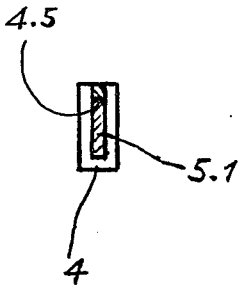
FIG. 4 is a sectional view of the stitch forming device of FIG. 3, taken substantially along the line B—B thereof.

With the modified embodiment of stitch forming device or stitch former shown in FIGS. 3 and 4 the closure element 4 is formed by a hollow profile member possessing a substantially rectangular cross-sectional configuration, and in the interior of which there is slidingly guided the body member 5.1 of a hook element 5. This body member 5.1 likewise possesses a substantially rectangular cross-sectional configuration. The hook 5.2 of the hook element 5 forms in conjunction with a bevelled or inclined portion 5.3 of the body member 5.1 a hollow throat or groove 6 for the reception of the thread or the like. Just as was the case with the embodiment of FIGS. 1 and 2, here also there is located a narrow nose 4.1 at the end of the closure element 4 which confronts the hook opening or groove 6 of the hook element 5. This narrow nose 4.1 has an outer surface 4.2 which is arranged at a greater elevation or height than the apex of the bevelled or inclined portion 5.3 of the body member 5.1 of the hook element 5, and whose end surface possesses a bevelled or inclined portion 4.3 which is inclined in the same direction as the bevelled or inclined portion 5.3 of the body member 5.1 of the hook element 5. The width of the nose member 4.1 is the same size as that of the body member 5.1 of the hook element 5, and its inner surface 4.4 possesses a substantially V-shaped groove 4.5. Engaging in a form-locking or positive fashion in this V-shaped groove 4.5 is the apex or zenithal line of the body member 5.1 of the hook element 5, which follows the bevelled or inclined portion 5.3, and also with the position "hook closed" the uppermost surface of the hook 5.2.

Figure 5:
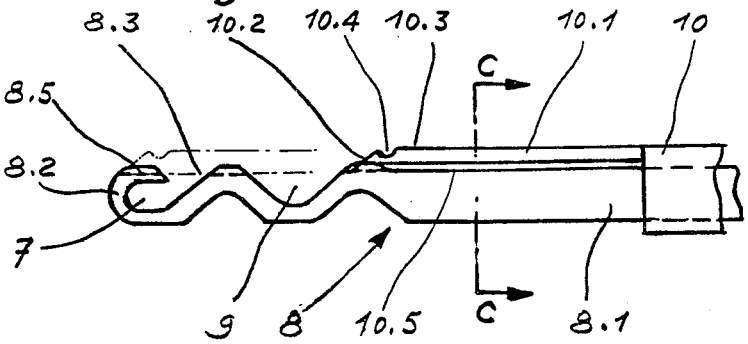
FIG. 5 is a fragmentary front view of a variant embodiment of stitch forming device in relation to the arrangement of FIGS. 3 and 4.
Figure 6:
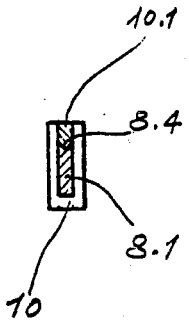
FIG. 6 is a sectional view of the stitch forming device shown in FIG. 5, taken substantially along the line C—C thereof.

With the embodiment of stitch former depicted in FIGS. 5 and 6 the hook element 8 possesses, in addition to a hollow throat or groove 7 for the reception of the thread or the like and formed by the hook 8.2 and the bevelled or inclined portion 8.3 of the body member 8.1 of the hook element 8, also a second hollow throat or groove 9 for the reception of the thread. The closure element 10 likewise consists of a substantially rectangular hollow profile member and possesses a nose 10.1. This nose or nose member 10.1 has a width which is essentially the same size as that of the body member 8.1 of the hook element 8, and its end possesses a bevelled or inclined portion 10.2. The outer surface 10.3 of the nose or nose member 10.1 is located above the body member 8.1 of the hook element 8 and possesses a notched portion 10.4 into which there is inserted, during the stitch forming operation, an already previsiously formed knitted stitch or float stitch. The inner surface 10.5 of the nose member 10.1 slides within a substantially V-shaped groove 8.4 which is imbedded in the uppermost surface of the body member 8.1 of the hook element 8 and, during the position "hook closed", is supported in a similar V-shaped groove 8.5 at the upper most part of the hook 8.2.

Figure 7:
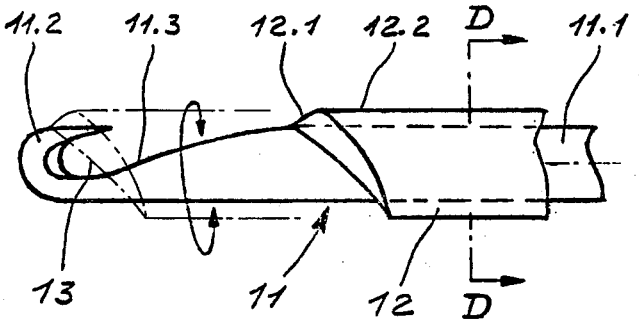
FIG. 7 is a fragmentary front view of a still further embodiment of stitch forming device or unit.
Figure 9:
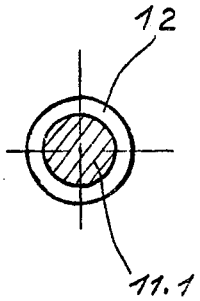
FIG. 9 is a cross-sectional view of the stitch forming device of FIG. 7, taken substantially along the line D—D thereof.
Figure 8:
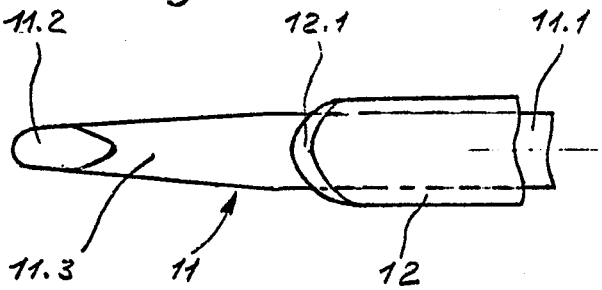
FIG. 8 is a top plan view of the stitch forming device of FIG. 7.

FIGS. 7 to 9 depict an exemplary embodiment of the invention in which the body member 11.1 of a substantially cylindrical hook element 11 is slidingly guided in the tubular-shaped closure element 12. The hook 11.2 as well as the bevelled or inclined portion 11.3 of the body member 11.1 of the hook element 11, which form a hollow throat or groove 13 for the reception of the thread or the like, are similarly constructed as the end of a crochet needle. Apart from the outstanding rigidity possessed by this stitch forming device or unit, which is constituted by the hook element 11 and the tubular-shaped closure element 12, there also is present an extremely great non-sensitivity of the hook 11.2.

The outer surface 12.2 of the closure element 12 possesses at the end confronting the hook opening or groove 13 of the hook element 11 a bevelled or inclined portion 12.1. This bevelled or inclined portion 12.1 is inclined in the same direction as the bevelled or inclined portion 11.3 of the hook element 11, by means of which there can be raised, during the stitch forming operation, an already previously formed knitted stitch or float stitch and such can be deposited upon the outer surface 12.2 of the closure element 12. During closing of the hook 11.2 the knitted stitch or float stitch which has been deposited upon the outer surface 12.2 of the closure element 12 is sloughed or knocked-off, whereas at the same time a new stitch is formed in conventional fashion with the new thread which has been introduced into the hollow throat 13.

With such relatively simple constructional embodiment there is appreciably facilitated the fabrication of the stitch forming device or unit. Another important advantage resides in the fact, that it is possible for the hook element 11 to be rotated within the closure element 12, as has been shematically represented in FIG. 7 by the double-headed arrow. By appropriately controlling the hook element 11 it is possible to obtain knitted stitches or float stitches having one or a number of twists in the one or the other direction. In this way it is possible to produce novel knitted goods having twisted or twist effects.

Figure 10:
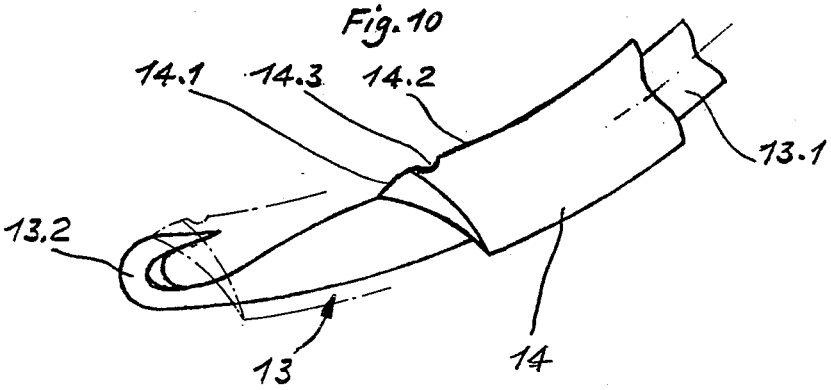
FIG. 10 is a fragmentary front view of a still further embodiment of stitch forming unit constituting a modification of the arrangement of FIGS. 7 to 9.

With the embodiment of FIG. 10 the body member 13.1 of the cylindrical hook element 13, whose hook 13.2 is formed in the same manner as the hook of a crochet needle, is slidingly guided in the tubular-shaped closure element 14. Both elements 13 and 14 are curved over at least a portion of their length, and the end of the closure element 14, which possesses a bevelled or inclined portion 14.1, is provided at its outer surface 14.2 with a notched portion 14.3. By means of this notched portion 14.3, during the formation of a new stitch, there can be fixedly retained or held the previously formed stitch which has been upwardly displaced by the bevelled or inclined portion 14.1.

It is within the teachings of the present invention to provide, apart from the described constructional embodiments, other modifications of the stitch forming units or devices. Thus, for instance, the hook element and the closure element, instead of possessing a rectangular or a circular cross-sectional area, also could possess a different cross-sectional configuration, for instance an elliptical cross-sectional configuration. Just as was the case for the cross-section of the body member of the hook element and the closure element, also the outer surface can have a different shape than the shapes depicted for the exemplary embodiments illustrated in FIGS. 1 to 10 by way of example and not limitation. For instance, the outer surfaces of the nose member and the end of the closure element could be arranged lower than the apex of the body member of the hook element and could serve to transport either the knitted stitch or float stitch or, as is the case for the known compound needles, could render possible the sliding of the knitted stitches of float stitches. On the other hand, the hook element, namely in the case of a curved closure element, could be formed of a flexible material.

The means for controlling both elements of the stitch forming device do not constitute the immediate subject matter of the present invention and, therefore, have not been particularly illustrated in the different exemplary embodiments of stitch forming devices heretofore disclosed. The hook element and the closure element can be actuated, for instance, by conventional control elements, for instance control feet, which, in turn, are controlled in the usual manner by cam elements or the like. However, they also can be controlled through the use of sinkers or Bowden cables, by way of example. Equally, there could be obtained a possible rotational movement of the hook element through the use of a special auxiliary control, for instance by means of a threaded spindle and nut member.

It should be of course understood that the stitch forming devices of the present invention are not limited in their use to conventional knitting machines, rather, for instance, one or a number of the stitch forming devices can be provided in a special knitting machine or a different device having similar functions which are correlated to another knitting machine or another textile machine, for instance a loom.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A stitch forming device for knitting machines or the like, comprising:

a hook element having a body member and a hook arranged at one end of the body member and defining a hook opening;

said body member having a bevelled portion forming a hollow throat with said hook opening;

a closure element cooperating with said hook element;

said closure element being constructed over at least a portion of its length by a closed hollow body member;

said closed hollow body member slidingly guiding said hook element;

said closed hollow body member possessing a nose-shaped portion forming an inner surface and an end surface at the end thereof confronting said hook opening;

said end surface of said nose-shaped portion being bevelled in the same direction as said bevelled portion of said body member of said hook element; and said closure element and said hook element being displaceable relative to each other to define a closed position and an opened position with respect to said hook in which said nose-shaped portion of said closed hollow body member bears upon said hook and upon said body member, respectively.

2. The stitch forming device as defined in claim 1, wherein:

said closure element comprises a substantially linear element.

3. The stitch forming device as defined in claim 1, wherein:

said closure element is curved at least over a portion of its length.

4. The stitch forming device as defined in claim 1, wherein:

at least said closed hollow body member of the closure element possesses a substantially rectangular cross-sectional configuration.

5. The stitch forming device as defined in claim 1, wherein:

at least said closed hollow body member of said closure element possesses a substantially circular cross-sectional configuration.

6. The stitch forming device as defined in claim 1, wherein:

at least said closed hollow body member of said closure element possesses a substantially elliptical cross-sectional configuration.

7. The stitch forming device as defined in claim 1, wherein:

at least a portion of the length of the hook element possesses a substantially circular cross-sectional configuration.

8. The stitch forming device as defined in claim 1, wherein:

said hook element and closure element are mounted for relative rotation with respect to one another.

9. The stitch forming device as defined in claim 1, wherein:

said nose-shaped portion of said closed hollow body member of said closure element possesses at least one notched portion at an outer surface thereof.

10. The stitch forming device as defined in claim 1 wherein:

said body member of said hook element is provided with at least one further hollow throat.

11. The stitch forming device as defined in claim 1, wherein:

said hook of the hook element comprises a hook of a crochet needle.

12. The stitch forming device as defined in claim 1, wherein:

said hook element is provided with a substantially V-shaped groove which extends at a top surface of said hook as well as at a top surface of said body member; and said inner surface of said nose-shaped portion of said closed hollow body member form-lockingly engaging said V-shaped groove in said closed position and said opened position of said closure element.

13. The stitch forming device as defined in claim 1, wherein:

said inner surface of said nose-shaped portion of said closed hollow body member possesses a substantially V-shaped groove;

each of said hook and said body member of said hook element having a top surface; and said top surface of said hook and said top surface of said body member of said hook element form-lockingly engaging said V-shaped groove in said closed and in said opened position of said closure element.

* * * * *